US008104745B1

(12) United States Patent
Fisenko

(10) Patent No.: US 8,104,745 B1
(45) Date of Patent: Jan. 31, 2012

(54) HEAT-GENERATING JET INJECTION

(76) Inventor: Vladimir Vladimirovich Fisenko, St. Petersburg (RU)

( * ) Notice: Subject to any disclaimer, the term of this patent is extended or adjusted under 35 U.S.C. 154(b) by 0 days.

(21) Appl. No.: 12/951,029

(22) Filed: Nov. 20, 2010

(51) Int. Cl.
*B01F 3/04* (2006.01)

(52) U.S. Cl. ..... 261/21; 261/76

(58) Field of Classification Search ..... 261/21, 261/76, 116
See application file for complete search history.

(56) References Cited

U.S. PATENT DOCUMENTS

| | | | | |
|---|---|---|---|---|
| RE22,590 | E * | 1/1945 | Miller | 261/76 |
| 2,632,597 | A * | 3/1953 | Boeckeler | 417/196 |
| 3,524,630 | A * | 8/1970 | Marion | 261/76 |
| 3,761,065 | A * | 9/1973 | Rich et al. | 261/76 |
| 4,265,702 | A * | 5/1981 | Prudhon et al. | 159/48.1 |
| 4,812,049 | A * | 3/1989 | McCall | 366/174.1 |
| 6,019,820 | A * | 2/2000 | Leverett | 95/216 |
| 6,042,089 | A * | 3/2000 | Klein | 261/76 |
| 6,416,042 | B1 * | 7/2002 | Popov | 261/76 |
| 7,416,171 | B2 * | 8/2008 | Brice | 261/76 |
| 2006/0027100 | A1 * | 2/2006 | Kozyuk | 95/260 |

FOREIGN PATENT DOCUMENTS

| | | | |
|---|---|---|---|
| RU | 2110701 | C1 | 5/1998 |
| RU | 2155280 | C1 | 8/2000 |
| RU | 2008138162 | A | 3/2010 |

* cited by examiner

*Primary Examiner* — Charles Bushey
(74) *Attorney, Agent, or Firm* — Connolly Bove Lodge & Hutz LLP; Jonathan A. Jaech

(57) ABSTRACT

A reboiling jet apparatus comprises at least two nozzles in series, configured to cause boiling of a hot liquid in the first nozzle, deceleration and reduction of the gas phase in the second nozzle, followed by acceleration and reboiling in the second nozzle. A second deceleration and reduction of the gas phase occurs at the outlet of the second nozzle. Each deceleration causes heating of the liquid by reduction of the gas phase; thus, energy of a pressurized input fluid is efficiently converted into heat by action of the nozzles. A convergent-divergent nozzle for steam injection with a mixing chamber may be used instead of the first nozzle to cause the first boiling. Another nozzle may be used to introduce a cold fluid at the outlet of the second nozzle for mixing with the hot flow prior to completion of the second deceleration.

6 Claims, 5 Drawing Sheets

HEAT-GENERATING JET INJECTION

BACKGROUND

1. Field

The present disclosure relates to injection jet technology, for example, injectors and injection methods for heating a pumped or ejected medium.

2. Description of Related Art

A heat-generating jet apparatus and method including two phase conversions with the liquid flow of the heat carrier mixture is disclosed in Russian Patent No. RU2110701 by the author hereof, issued May 10, 1998. One of these conversions includes the acceleration of the heat carrier mixture, its boiling, formation of a boiling dual-phase supersonic flow with a Mach number of more than 1, and then a sudden change of pressure with heating of the liquid flow. Another conversion includes the acceleration of the flow, its boiling, formation of a flow mode with a Mach number equal to 1, deceleration of the flow and its conversion into an isotropic liquid flow filled with microscopic vapor-gas bubbles with additional heating of the liquid. Vapor can be used as one of the heat carriers. This method allows intensifying of the heat carrier heating.

However, this method is less efficient than desirable. Efficiency is reduced by the internal flow's energy transforming into kinetic energy with supersonic flow on the second step of conversion of the dual-phase flow into the liquid flow with vapor-gas bubbles. Meanwhile it is known that transforming of the internal energy into kinetic form is more intensive, the higher the Mach number. Loss of efficiency is particularly typically for dual-phase flows, in which a Mach number can be several times that in single-phase flows at the same or similar parameters of the decelerated flow. In addition, prior art injection nozzles have not been able to achieve continuous acceleration of the boiling flow up to the supersonic velocity necessary to achieve the advantages of dual-conversion jet injection.

It would be desirable, therefore, to overcome these and other limitations of the prior art in a jet injection apparatus and method for heating a pumped or ejected medium.

SUMMARY

The present technology may achieve these and other objectives for improved jet injection, such as, for example, achieving an increase of the operation efficiency of a jet apparatus by means of an intensification of heating of the heat carrier by a more complete use of both the energy of the heating medium due to reaching supersonic flow as it leaves the accelerating nozzle, and increase of the heated heat carrier's energy due to reduction of the pressure in the outlet from the accelerating nozzle leading to boiling up the pumped liquid as well. A jet injection apparatus according to the new technology may use a nozzle as first described by the author of the present invention in Russian Patent Application No. 2008138162, filed on Sep. 25, 2008 and first published on Mar. 27, 2010, which reference is incorporated herein, in its entirety, by reference.

A method of operation of the jet heat transfer apparatus may comprise feeding of a hot liquid input heat carrier into the nozzle under pressure and feeding of a cold input liquid heat carrier and their mixing so as to carry out the following state changes. In some embodiments, both inputs comprise water. The first two of the state changes are carried out with the heated liquid and include acceleration of the hot (heating) heat carrier up to a first velocity at which it boils with formation of a non-homogenous dual-phase flow. The dual-phase flow is accelerated through a nozzle to a velocity having a Mach number of at least 1 then caused to undergo a sudden increase in pressure by deceleration, which converts the dual-phase flow to a subsonic homogenous and isotropic liquid flow with entrained microscopic gas bubbles and heats the liquid heat carrier. The heated liquid carrier with gas bubbles is then accelerated to a velocity at which the heat carrier mixture again boils and again results in a non-homogenous dual-phase flow of the heat carrier. The acceleration is carried out such that the Mach number increases to 1 inside a divergent nozzle section, and then the Mach number increases to greater than 1 in the outlet of the nozzle.

A third state change is performed on the heat-receiving (originally lower temperature) heat carrier. The heat-receiving heat carrier is accelerated up to a velocity at which it boils and forms a dual-phase flow with a Mach number close to or equal to 1, that is, to a near-sonic velocity. Therefore the processes described above result in two dual-phase flows: a supersonic flow of the heating heat carrier and near-sonic flow of heat-receiving heat carrier. The supersonic and near-sonic flows are mixed to form a supersonic dual-phase flow mixture, which is then decelerated. As a result of deceleration, the mixed flow is converted to a homogenous isotropic liquid flow of the heat carrier mixture filled with microscopic vapor-gas bubbles. Additionally due to the conversion of the flow to a primarily liquid state, the liquid flow of the mixture is heated, and the heated liquid flow of the heat carrier mixture with vapor-gas bubbles is fed to the consumer under the pressure obtained in the jet apparatus.

The present technology may include variations on the method summarized above, as follows. For example, in one alternative embodiment the heated liquid carrier is vaporized and fed into the injection nozzle under pressure to mix with the cold liquid heat-receiving fluid. For example, a hot input fluid may comprise steam and the cold input may comprise water. The vaporized heat carrier fed into the nozzle mixes with the receiving liquid to form a supersonic non-homogenous dual-phase flow with a Mach number of more than 1 at the nozzle outlet. Then, the pressure of the flow is suddenly increased to cause conversion of the supersonic dual-phase flow into a single-phase liquid flow of the heat carrier mixture therein, while simultaneously causing heating of the heat carrier mixture during the sudden change of pressure by condensation of the vapor phase. Thereafter, the flow of the heat carrier mixture is accelerated to a velocity at which the heat carrier mixture boils to again cause formation of a supersonic dual-phase flow with a Mach number of more than 1. Subsequently, the flow is decelerated to cause conversion of the dual-phase flow into a homogenous isotropic liquid flow of the heat carrier mixture filled with microscopic vapor-gas bubbles, additional heating of the heat carrier mixture and a pressure increase. Thereafter, the heated liquid flow of the heat carrier mixture may be fed to a consumer under the pressure obtained in the jet apparatus.

In another embodiment, the heated liquid carrier is vaporized and fed into the injection nozzle under pressure to mix with the cold liquid heat-receiving fluid. The vaporized heat carrier fed into the nozzle mixes with the receiving liquid to form a supersonic non-homogenous dual-phase flow with a Mach number of more than 1 at the nozzle outlet. Then, by decelerating the dual-phase flow, it is converted into a homogenous isotropic liquid flow of the heat carrier mixture filled with microscopic vapor-gas bubbles. Deceleration also causes heating of the flow by condensation of the vapor phase and a pressure increase in the flow. Subsequently, the flow of the heat carrier mixture is accelerated to a velocity at which the heat carrier mixture again boils to form a supersonic non-homogenous dual-phase flow with a Mach number of more than 1. Then additional heat-receiving carrier is fed and accelerated up to a velocity at which it boils and forms a dual-phase flow with a Mach number close to or equal to 1, that is, to a near-sonic velocity. Therefore the process results in two dual-phase flows: a supersonic flow of the hot heat carrier mixture and near-sonic flow of heat-receiving heat carrier. The supersonic and near-sonic flows are mixed to form a supersonic dual-phase flow mixture, which is then decelerated. As a result of deceleration, the mixed flow is converted to a homogenous isotropic liquid flow of the heat carrier mixture filled with microscopic vapor-gas bubbles. Additionally due to the condensation of the vapor phase within the flow to a primarily liquid state, the liquid flow of the mixture is heated, and the heated liquid flow of the heat carrier mixture with microscopic vapor-gas bubbles is fed to the consumer under the pressure obtained in the jet apparatus.

A jet apparatus for performing a method as described above using a hot liquid input feed may comprise at least two nozzles connected in series, as follows. A first nozzle configured to cause boiling of a hot liquid fed under pressure to a first nozzle, and a second nozzle coupled to an outlet of the first nozzle, configured to cause deceleration and reduction of a gas phase of the hot liquid, followed by acceleration and reboiling in the second nozzle, and a second deceleration and reduction of the gas phase at an outlet of the second nozzle. The first nozzle may comprise a channel of constant cross-section. The first nozzle may further comprise a sharp edged inlet mouth configured to cause flow separation of the feed. The channel may be generally cylindrical and may have a fluid length in the range of about 0.5 to 1 times its diameter. The second nozzle may comprise a diffuser with varying divergence. The jet apparatus may further comprise a third nozzle in fluid communication at its outlet with an outlet of the second nozzle, and in fluid communication at its inlet with a connection for a pressurized liquid feed. The jet apparatus may further comprise a connection for a discharge channel coupled to the outlet of the second nozzle.

A jet apparatus for performing a method as described above using a hot vapor input feed, for example steam, may comprise at least two nozzles connected in series, as follows. A first nozzle configured to inject a vapor phase of a liquid material through a first nozzle into a cooler liquid phase of the material to provide a boiling hot liquid flow in a mixing chamber downstream of the first nozzle may be coupled to a constant cross-section channel via the mixing chamber. The channel may be configured to cause deceleration and reduction of a gas phase of the hot liquid flow. A second nozzle may be coupled to an outlet of the constant cross-section channel, configured to cause acceleration and reboiling in the second nozzle followed by a second deceleration and reduction of the gas phase at an outlet of the second nozzle. The first nozzle may comprise a convergent-divergent nozzle. The jet apparatus may comprise a third nozzle in fluid communication at its outlet with an outlet of the first nozzle, and in fluid communication at its inlet with a connection for a pressurized liquid feed. The constant cross-section channel may be generally cylindrical and may have a fluid length in the range of about 4 to 6 times its diameter. The second nozzle may comprise a diffuser with varying divergence. The jet apparatus may comprise a connection for a discharge channel coupled to the outlet of the second nozzle. The jet apparatus may comprise a third nozzle in fluid communication at its outlet with an outlet of the second nozzle, and in fluid communication at its inlet with a connection for a pressurized liquid feed.

As the foregoing examples demonstrate, mixing and heating of a liquid heat carrier in a jet apparatus using a sudden change of pressure, in combination with the conversion of the flow between a homogenous isotropic liquid and non-homogenous dual-phase flow is provided for enhanced efficiency of heat transfer. A more complete understanding of the jet injection apparatus and method will be afforded to those skilled in the art, as well as a realization of additional advantages and objects thereof, by a consideration of the following detailed description. Reference will be made to the appended sheets of drawings, which will first be described briefly.

DETAILED DESCRIPTION

Figure 1:
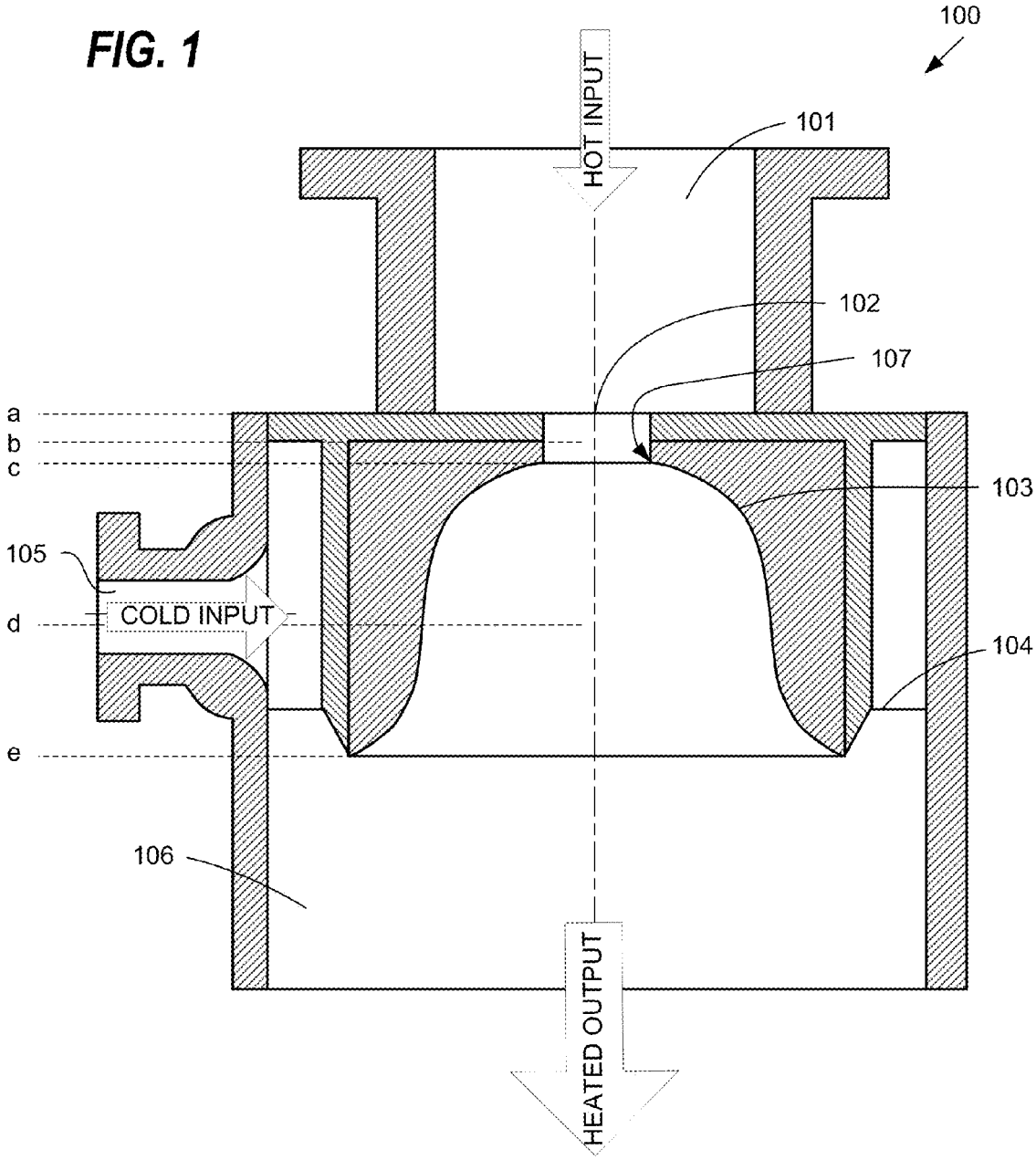
FIG. 1 is a schematic view of a flow section for a jet apparatus suitable for performing a method of operation as described herein, using hot water as a heating medium.

Before describing the present apparatus and methods in more detail, certain theoretical considerations are presented in support of the disclosed embodiments. One such consideration concerns initiation of boiling in the process stream. To prevent lagging in the initiation of the boiling process after the vapor saturation pressure is achieved in the process flow, presence of vapor transformation centers in a liquid flow may be needed. The problem does not arise in embodiments in which vapor is used as a hot heat carrier, because vapor injection causes many microscopic bubbles to be present in the liquid flow. These bubbles can include vapors with the temperature far exceeding the temperature of the liquid carrying them, and thus, these bubbles serve as the centers of transformation.

A different situation arises where a hot liquid, for example water, is used as a heating medium. A suitable nozzle for hot liquid, described in Russian Patent Application 2008138162 by the author of the present application has a smooth intake end in the convergent section that, in absence of the centers of transformation, leads to delay of the liquid boiling even after the significant reduction of pressure to less than the saturation pressure. This, in its turn, causes the nozzle's action to be different from that calculated in theory, and consequently to loss of efficiency of the whole device.

To avoid this disadvantage, this or similar nozzles may be configured with a sharp-edged mouth on the nozzle's inlet as a vapor generating device. When so equipped, the diameter of the nozzle's bottleneck should be properly sized according to the considerations described below. In hydrodynamics, Zhukovsky N. E. suggested the following formula for determination of coefficient of liquid discharge from the vessel or conduit of the larger diameter into the atmosphere:

$$\mu = .57 + \frac{.043}{\left[1.1 - \left(\frac{d}{D}\right)^2\right]}$$

where d is the mouth's diameter; D is the supply line's diameter.

When D>>d, μ=0.609.

The set dependence sufficiently well describes the results of cold liquid discharge into an unrestricted space at atmospheric pressure in the form of free spraying jet. However, the formula does not accurately describe discharge into a limited and flooded space having a counter-pressure greater than atmospheric, and the question of throat diameter remained undetermined for wide range of initial temperatures and pressures. The physical essence of the processes in the jet was also not fully understood. Boiling liquid flow behavior in the nozzle with the vapor-generating insert on its inlet and divergent section executed may be described according to the calculating method described in Application No. 2008138162 for the device shown in FIG. 1. A distinctive feature of the nozzle 102 is that upon reduction of pressure along its axis and resultant boiling of the process liquid, transition through sonic speed occurs twice. It first occurs where a minimal volumetric ratio of phases 'β,' defined as the ratio of gas component volume to the total volume of liquid-gas mixture, achieves a value of ⅓ (one third). This occurs at the outlet from the sharp-edged mouth, located in the nozzle's bottleneck at the entrance 107 to its divergent section 103. Transition through sonic speed occurs a second time at β(P01) at maximal volumetric ratio of phases in the outlet 104 of the nozzle depending on the pressure P01 in the nozzle's outlet section.

Flow rates of mixture in the nozzle's outlet and inlet are the same and are determined by one and the same dependence:

$g_{cr}$(P01)·f, where f is the square of the cross-section, and $g_{cr}$(P01) is the specific critical mass flow of mixture in the pressure function before a sudden change, which is related with a stagnation pressure by dependence:

$$P01 = Po(P01) \cdot \frac{(1 - \beta(P01))}{k(P01)},$$

where k is the isentropic exponent, which is the function of the changing pressure P01 in the nozzle's divergent section as well as volumetric ratio of phases and stagnation pressure. The specific critical flow is equal to:

$g_{cr}$(P01)=(k(P01)·P01·ρ·(1−β(P01)))$^5$, where ρ is the liquid density, as ratio of nozzle's section squares is equal to inverse relation of specific flow rates:

$$\frac{f}{F} = \left[\frac{k(P01) \cdot P01 \cdot \rho \cdot (1 - \beta(P01))}{k1 \cdot P01 \cdot \rho \cdot (1 - \beta 1)}\right]^5$$

Relating the set dependencies based on equality of stagnation pressure in the outlet section of the accelerating nozzle 102 and in the entrance 107 to the nozzle's divergent section 103, ratio of squares of the sharp-edged mouth's and the nozzle's outlet section will be inversely related to ratio of volumetric ratios M of liquid to gas phase in these cross-sections, and diameters ratio will be equal to:

$$\frac{d(P01)}{D(P01)} = \left(\frac{1 - \beta(P01)}{1 - \beta 1}\right)^5$$

In view of the sudden change of pressure:

$$a(P01)^2 = w1(P01) \cdot w2(P01), \text{ where}$$

a(P01) is the sonic velocity, w1(P01) is the velocity of dual-phase mixture before a sudden change of pressure, w2(P01)=w1(P01)×(1−β(P01)) is the velocity of dual-phase mixture after a sudden change of pressure. When substituting this expression into the condition of presence of a sudden change of pressure we get:

$$M(P01)^2 = \frac{1}{(1 - \beta(P01))}$$

Consequently, the ratio of squares of diameters of the mouth in the entrance of the accelerating nozzle and the outlet section of the nozzle can be written as follows:

$$\frac{d(P01)^2}{D(P01)^2} = \frac{M1^2}{M(P01)^2},$$

Where d is the diameter at the nozzle entrance, D is the diameter at the nozzle outlet, and M is the volumetric liquid/gas phase ratio. If this ratio is substituted into the formula of Zhukovsky N. E. cited above, than it is converted to:

$$\mu(P01) = .57 + \frac{.043}{1.1 - \frac{M1^2}{M(P01)^2}}$$

or in view of that volumetric ratio of phases in the entrance of the divergent section of the nozzle is ⅓ M1=1.5 we get a formula, in which the flow coefficient is not dependent either on the mouth's diameter, or on the supply line's diameter, but it depends only on the characteristics of the process liquid in the case where the shape and geometrical sizes of the jet discharging through the sharp-edged mouth are set according to a specific supersonic nozzle for boiling dual-phase flow, as described in Russian Patent Application No. 2008138162 by the author hereof:

$$\mu(P01) = .57 + \frac{.043 \cdot M(P01)^2}{(1.1 \cdot M(P01)^2 - 2.25)},$$

Despite this expression for the flow coefficient indicating dependence on pressure in the outlet of the nozzle, which in its turn depends on the liquid's (in the considered case water) characteristics in the entrance to the nozzle, calculations executed according to this formula in a wide range of temperatures (from 20° C. to 200° C.) and pressures (from 0.2 to 2 MPa) in the entrance to the nozzle, the flow coefficient remains constant, equal to its value calculated according to the formula of Zhukovsky N. E. for condition D>>d: μ=0.609.

This points to the fact that this value has a fundamental nature and determines the most important features of water: its compressibility and potential internal energy.

Application No. 2008138162 describes how to determine the diameter D(P01) in the outlet section of the accelerating nozzle working on boiling liquid. The mouth's diameter at the entrance to the nozzle is determined by the following dependence:

$$d(P01) = \frac{1.5 \cdot D(P01)}{M(P01)},$$

where the nozzle 102 length is in the range of about 0.5 to 1.0 times the mouth's diameter d.

In accordance with the foregoing, FIG. 1 presents a schematic view of a flow section for a jet apparatus 100 for performing a method as described herein, using hot water as the heating medium. The heat-generating jet apparatus 100 may comprise an inlet 101, a nozzle 102 with a profiled divergent nozzle 103, a mixing nozzle 104, a branch inlet 105 and an outlet 106.

The heat-generating jet apparatus 100 may be operated as follows. In case a liquid medium is used as the heated heat carrier, this medium is fed under pressure into the nozzle 102. The heated liquid heat carrier is fed from the inlet 101 into the accelerating diffuser 103 through the vapor generating nozzle 102. At this, in the section (a) the flow separates from the sharp edge, the flow narrows, pressure in it decreases, causing boiling of the flow continuing in the narrow section (b) as well. Volumetric ratio of gas to liquid phases becomes ⅓, the flow becomes supersonic and a sudden change of a pressure happens in the outlet 107 from the nozzle 102 in the section (c). In the entrance to the accelerating nozzle 103 the flow is primarily liquid with microscopic vapor bubbles, which being the vapor generating centers facilitate rapid initiation of the liquid boiling while pressure in dual-phase flow decreases.

The nozzle 103 may have a diffusing profile with variable divergence, as shown. Here, the mixture's density decreases and velocity grows, in section (d) the flow becomes critical and it further expands with supersonic velocity. In section (e) the velocity reaches its maximum and the pressure reaches its minimum. The heat-receiving water fed to the annular mixing nozzle 104 through the branch pipe 105 also boils due to the low pressure in the section (e) and mixes with the dual-phase flow coming from the accelerating nozzle.

At this, the flows are mixed in such ratios and with such parameters that after near immediate exchange of movements the dual-phase mixture is fed to the outlet pipeline 106 at a supersonic velocity. The transition to the outlet 106 causes a sudden change (increase) of pressure in the pipeline 106. During the sudden change of pressure, the dual-phase flow transforms sharply into a homogenous isotropic single-phase liquid subsonic flow characterized by a volumetric gas to liquid ratio of less than ⅓. Here, such a sharp change of the state of phase flow is accompanied simultaneously by heating the flow during the sudden change of pressure. The flow of homogenous liquid may be filled with microscopic vapor bubbles formed at this stage. This flow is fed to a consumer as a heated liquid with, achieving an efficient and rapid thermal transfer from the input heating medium.

Theoretical parameter values for a water-water boiler as shown in FIG. 1 were calculated for a working prototype to be constructed as an example of technology disclosed herein. As of the date of this application, empirical data from the prototype is not yet available. Calculated inlet parameter values were as follows:

| | |
|---|---|
| Inlet pressure of hot water: | P1 = 0.44 MPa |
| Inlet temperature of hot water: | T1 = 110° C. |
| Power (Wattage) supplied to water: | ME = 500 kW |
| Geometrical values used: | |
| Diameter of narrow section of the nozzle: | d = 18 mm |
| Diameter of outlet section of the nozzle: | D = 116 mm |
| Calculated outlet parameters: | |
| Outlet pressure: | P2 = 0.138 MPa |
| Outlet temperature of water: | T2 = 77.6 C. |
| Outlet power (wattage): | Q = 1000.6 kW |
| Discharge of water: | g = 15 $m^3$/h |
| Sonic velocity before the sudden change: | a = 27.56 m/s |
| Pressure before the sudden change: | P0 = 0.0085 MPa |
| Velocity of flow before the pressure jump (sudden change): | w1 = 231.39 m/s |
| Mach number before the pressure jump (sudden change): | M = 8.39 |

The foregoing calculated values are merely illustrative, and should not be construed as limiting the inventive concepts disclosed herein. It should also be appreciated that empirical results may differ from the theoretical values presented above.

Other variants of realization of the method of operation of heat-generating jet apparatus differ from the above-described ones mainly in that vapor is fed under pressure into the inlet 101 of the jet apparatus as the heat-supplying carrier. That is, the heat-supplying carrier is injected in vapor form. Consequently, the process of heating the cold heat carrier by a transfer of a larger amount of heat to it, as well as the process of the formation of the dual-phase flow is intensified. Here, as described above, two phase conversions are carried out in the flow, i.e., the conversion of the flow of the heat carrier mixture by the sudden change of pressure and the conversion of the flow of the heat carrier mixture with setting the supercritical flow conditions. An essential difference consists in that the conversion of the flow of the heat carrier mixture carried out first does not require a special acceleration of the heat carrier mixture for boiling, which also allows the process of the heating of the heat carrier mixture to be accelerated, and bubbles formed in the liquid after a sudden change of a pressure serve as the centers of vapor generation during the liquid boiling in the accelerating nozzle.

Figure 2:
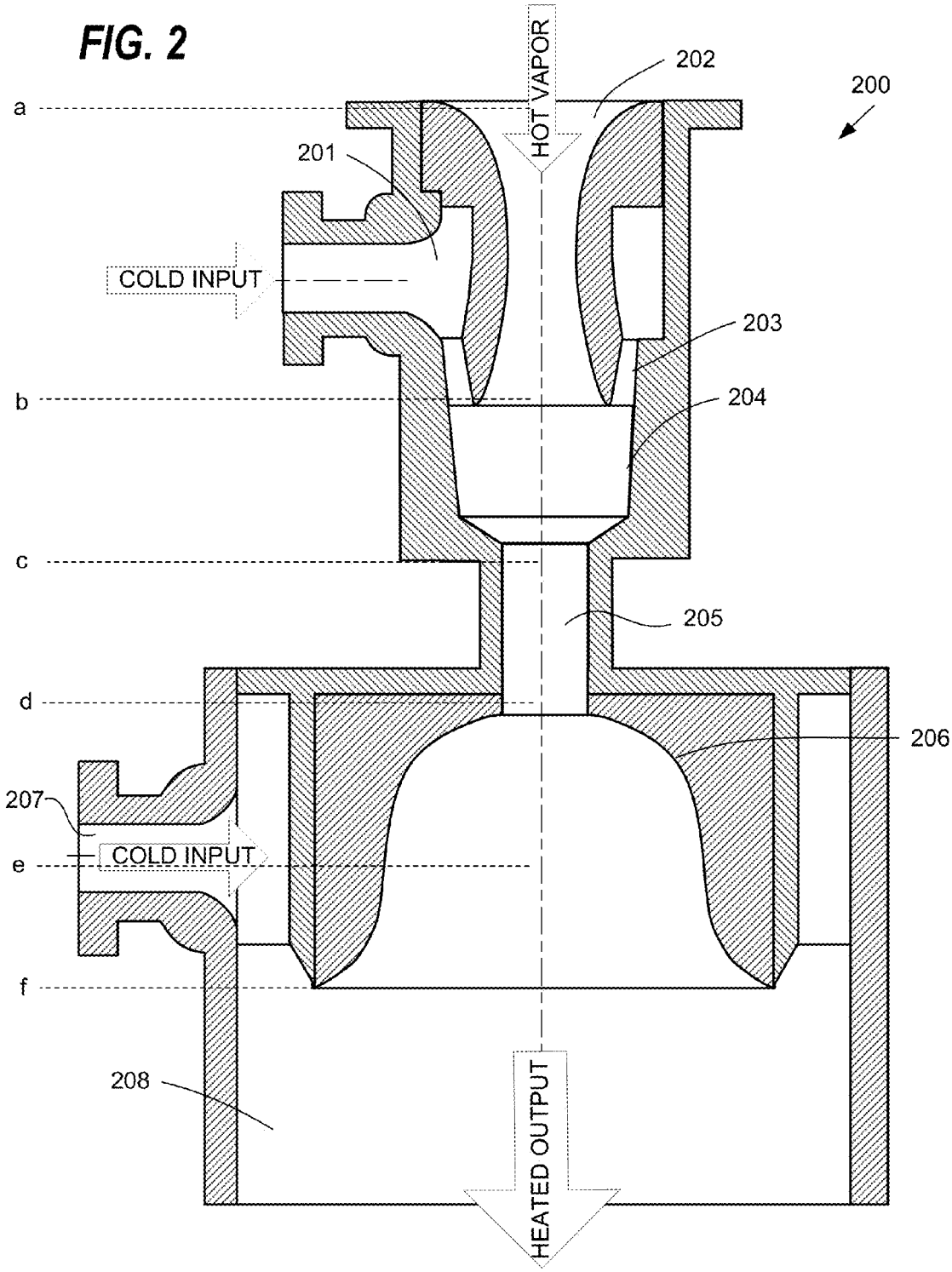
FIG. 2 is a schematic view of a flow section for a jet apparatus suitable for performing a method of operation as described herein, using vapor as a heating medium.
Figure 3:
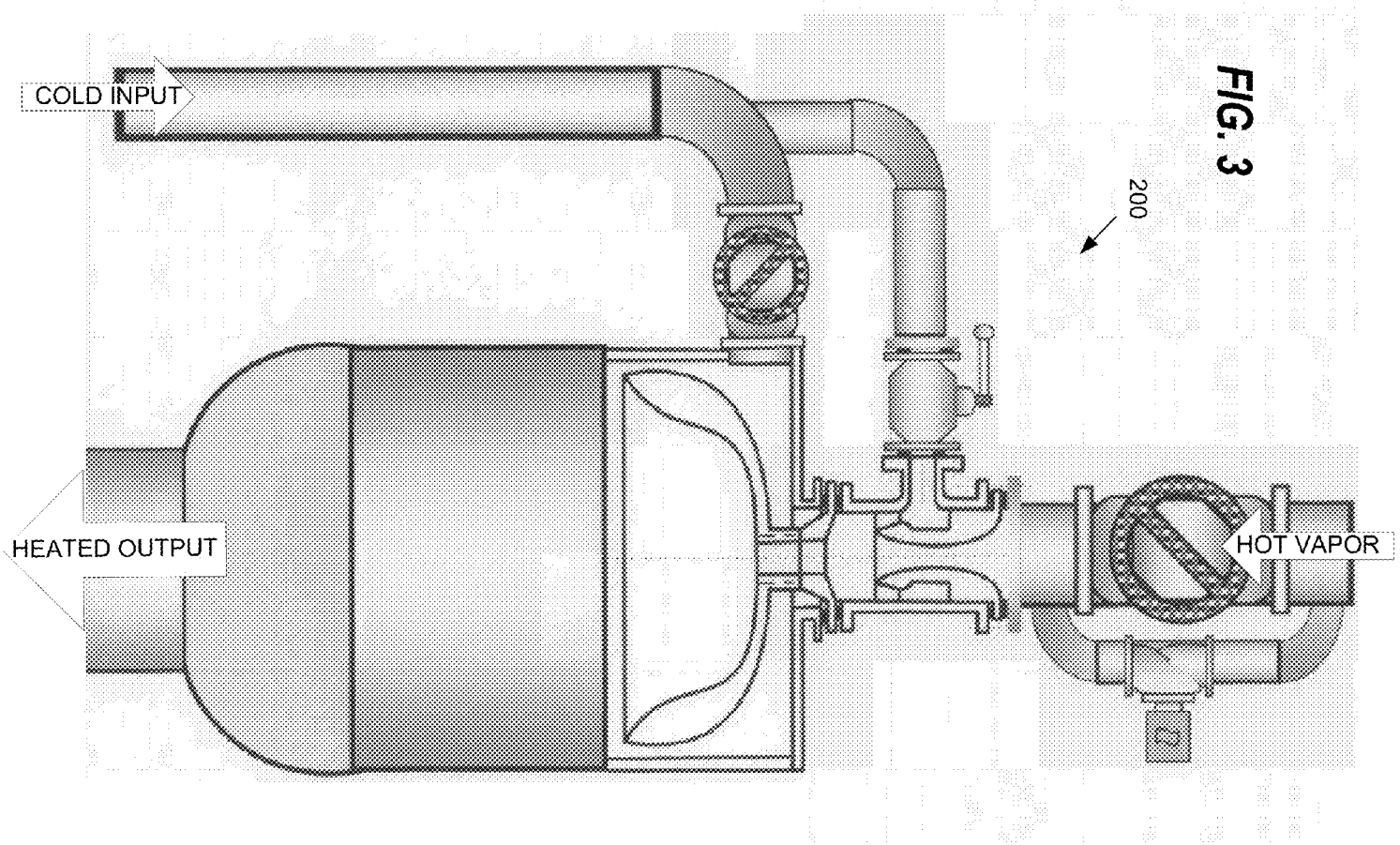
FIG. 3 is an alternative schematic diagram showing the apparatus of FIG. 2.

FIG. 2 therefore presents a schematic view of another apparatus 200 suitable for a method of operation as described herein, using vapor as the heating medium. FIG. 3 presents an alternative view of the jet apparatus 200. The apparatus may be understood as facilitating the following operations: feeding of the heat carrier vapor under pressure into the convergent-divergent nozzle 202 section (a), its outflow from the nozzle 202 with its entering into the mixing chamber 204, while a first cold stream for heating is also fed into the mixing chamber 204 from the receiving chamber 201 through the nozzle 203. During mixing the of heat carriers between sections (b and c) in the mixing chamber 204 downstream of the nozzles 202 and 203, a vapor-liquid mixture of heat carriers is formed. The vapor-liquid flow is accelerated to a supersonic speed by the converging entrance to the cylindrical part 205 of the mixing chamber. The vapor-liquid flow may have a volumetric gas/liquid ratio of about ⅓ around the entrance to the cylindrical portion 205.

After entering the cylindrical part 205 of the chamber, the vapor-liquid flow decelerates and undergoes a sudden increase in pressure. The cylindrical part 205 may be designed as described below to cause the deceleration and pressure increase. With the sudden increase of pressure, the dual-phase vapor-liquid flow is changed into a homogenous isotropic single-phase subsonic liquid flow with entrained microscopic bubbles having a volumetric gas/liquid ratio of less than ⅓. In addition, heating of this flow of the heat carrier mixture occurs during the sudden change of pressure in the cylindrical part 205 of the mixing chamber as a result of the reduction of the vapor phase. The flow is therefore discharged into the downstream nozzle 206 at a subsonic speed and elevated temperature.

The process liquid flow is then accelerated to a velocity at which the liquid flow will boil in the accelerating vapor-liquid nozzle 206. The nozzle 206 may have a diffusing profile with variable divergence, as shown. The process flow again achieves the conditions of a non-homogenous dual-phase flow with a volumetric liquid/gas ratio of more than ⅓ and a Mach number of 1 inside the accelerating nozzle section (e) portion of the profiled divergent nozzle 206. Then, the liquid flow is accelerated to a maximum velocity with a Mach number substantially greater than 1 in the outlet from the accelerating nozzle 206.

Two different variations of operation methods for the apparatus 200, both using vapor as the hot input carrier, may be performed as follows. In one embodiment the apparatus 200 is configured to operate such that, after the supersonic flow is reached in the outlet from the accelerating nozzle 206, by decelerating the flow during a sudden change of pressure, its transfer to the homogenous isotropic liquid flow of the heat carrier mixture filled with microscopic vapor-gas bubbles is realized in the outlet pipeline 208. This transfer is realized with additional simultaneous heating of the liquid flow of the heat carrier mixture from reduction of the vapor phase and with a pressure increase in the flow. Then the heated liquid flow of the heat carrier mixture is fed to the consumer under the obtained pressure. Nothing is fed via branch pipe 207, and this feature may be removed or shut off.

In an alternative embodiment, the apparatus 200 is configured to operate so that the feeding of hot input vapor differs from the above-described embodiment by the following features. A second cold liquid input stream is additionally fed through the branch pipe 207, and into outlet of the expansion nozzle 206 at section (f). Due to low pressure in this segment, the second cold input stream also boils and is accelerated to a near-sonic speed having the Mach number close to 1. Then the second cold stream is mixed with the hot dual-phase supersonic flow fed to the section (f) from the accelerating nozzle 206. The mixed dual-phase flow is supercritical. During a sudden change (increase) of pressure in the outlet pipeline 208 the said mixed dual-phase flow collapses into a homogenous isotropic liquid flow with microscopic entrained vapor bubbles. In this state the heated liquid may be discharged to the consumer at the pressure achieved in the outlet 208.

The first part of the apparatus 200 may comprise a transonic jet apparatus (TJA) as disclosed by Russian Patent No. RU2155280 by the author hereof, issued Aug. 27, 2000, modified to achieve the maximum possible deceleration pressure during a sudden change of pressure in the cylindrical part of the mixing chamber 204. In comparison, the corresponding portion of the TJA described in RU2155280 is configured in the form of a diffuser with a cone angle (γ). It is proved theoretically and confirmed by tests that at transonic flow for any set initial parameters of vapor and water in the inlet to TJA, the deceleration pressure after a sudden change (increase) of pressure has its maximum at a strictly defined value of a pressure achieved in the nozzle before a sudden change. Here, as it was shown above, the diameter of the section for achieving boiling dual-phase flow at a preset mass discharge is also the function of the pressure before a sudden change. Therefore, having determined the pressure before a sudden change at which deceleration pressure has it's maximum, one can determine the corresponding value of the diameter of the cylindrical part 205 of the mixing chamber 204. Experience has shown an optimal length 1' of the cylindrical part of the mixing chamber may be defined in the range of L=4 to 6 multiples of the mixing chamber diameter.

Figure 4:
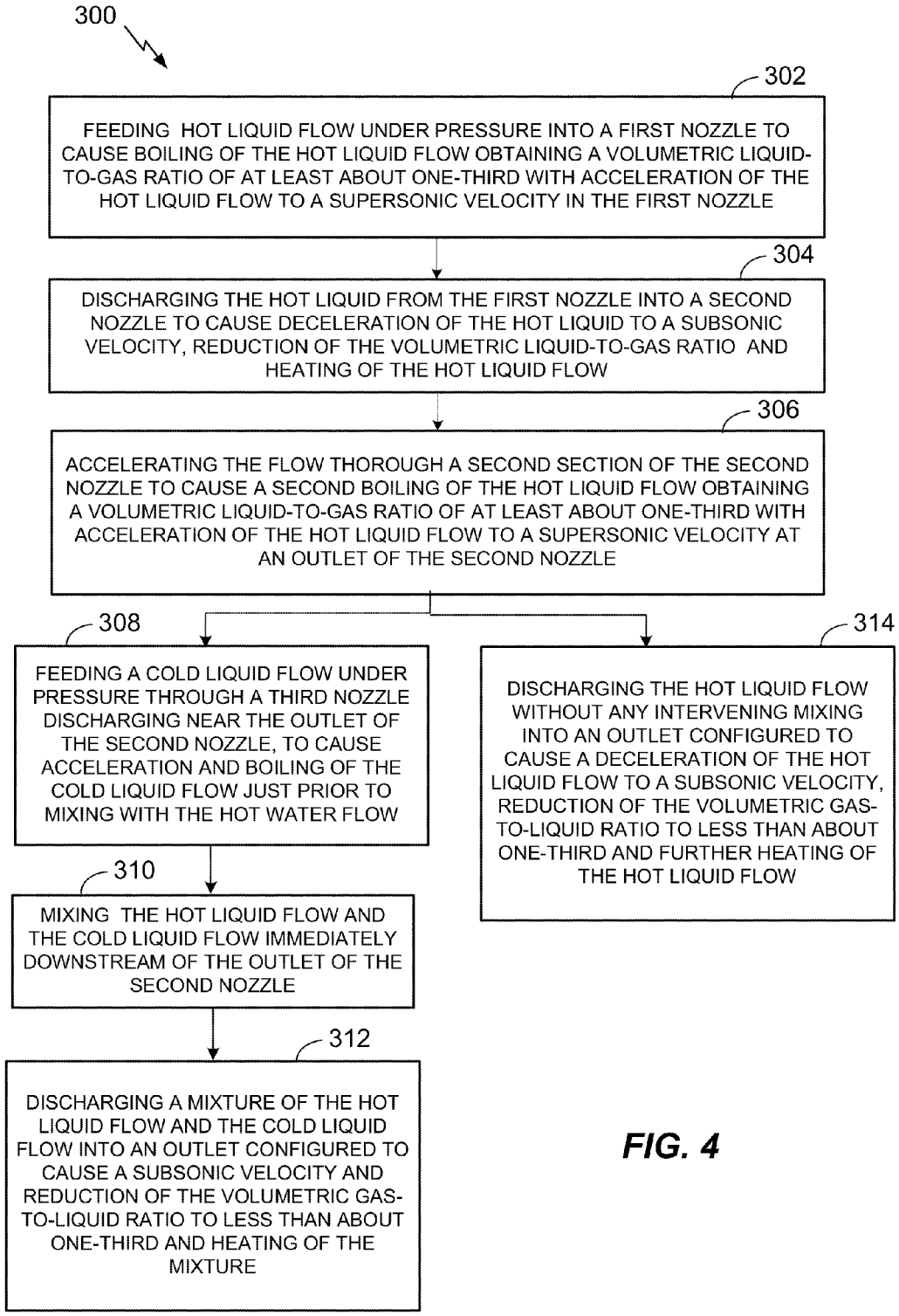
FIG. 4 is a flow diagram showing a method for operating a jet injection apparatus using a hot liquid as a heating medium.

In accordance with the foregoing, a method 300 of operating a jet apparatus for heating a fluid using a hot liquid feed may be performed as follows, as shown in FIG. 4. The method may comprise feeding 302 hot liquid flow under pressure into a first nozzle to cause boiling of the hot liquid flow obtaining a volumetric gas-to-liquid ratio of at least about one-third with acceleration of the hot liquid flow to a supersonic velocity in the first nozzle. The hot liquid flow may be feed into the first nozzle through a sharp-edged mouth (inlet) to cause flow separation and rapid boiling. Then, the method may further comprise discharging 304 the hot liquid from the first nozzle into a divergent section of a second nozzle to cause deceleration of the hot liquid to a subsonic velocity, reduction of the volumetric gas-to-liquid ratio to less than about one-third and heating of the hot liquid flow, converting the flow to a homogenous isotropic liquid with entrained microscopic vapor bubbles. The method may further comprise accelerating 306 the flow thorough a second section of the second nozzle to cause a second boiling of the hot liquid flow obtaining a volumetric gas-to-liquid ratio of at least about one-third with acceleration of the hot liquid flow to a supersonic velocity at an outlet of the second nozzle.

The method 300 may further comprise feeding 308 a cold liquid flow under pressure through a third nozzle discharging near the outlet of the second nozzle, to cause acceleration and boiling of the cold liquid flow just prior to mixing with the hot water flow. The method may further comprise mixing 310 the hot liquid flow and the cold liquid flow immediately downstream of the outlet of the second nozzle. The method may further comprise discharging 312 a mixture of the hot liquid flow and the cold liquid flow into an outlet configured to cause a deceleration of the mixture to a subsonic velocity and reduction of the volumetric gas-to-liquid ratio to less than about one-third and heating of the mixture. In the alternative, the method may further comprise discharging 314 the hot liquid flow without any intervening mixing into an outlet configured to cause a deceleration of the hot liquid flow to a subsonic velocity, reduction of the volumetric gas-to-liquid ratio to less than about one-third and further heating of the hot liquid flow.

Figure 5:
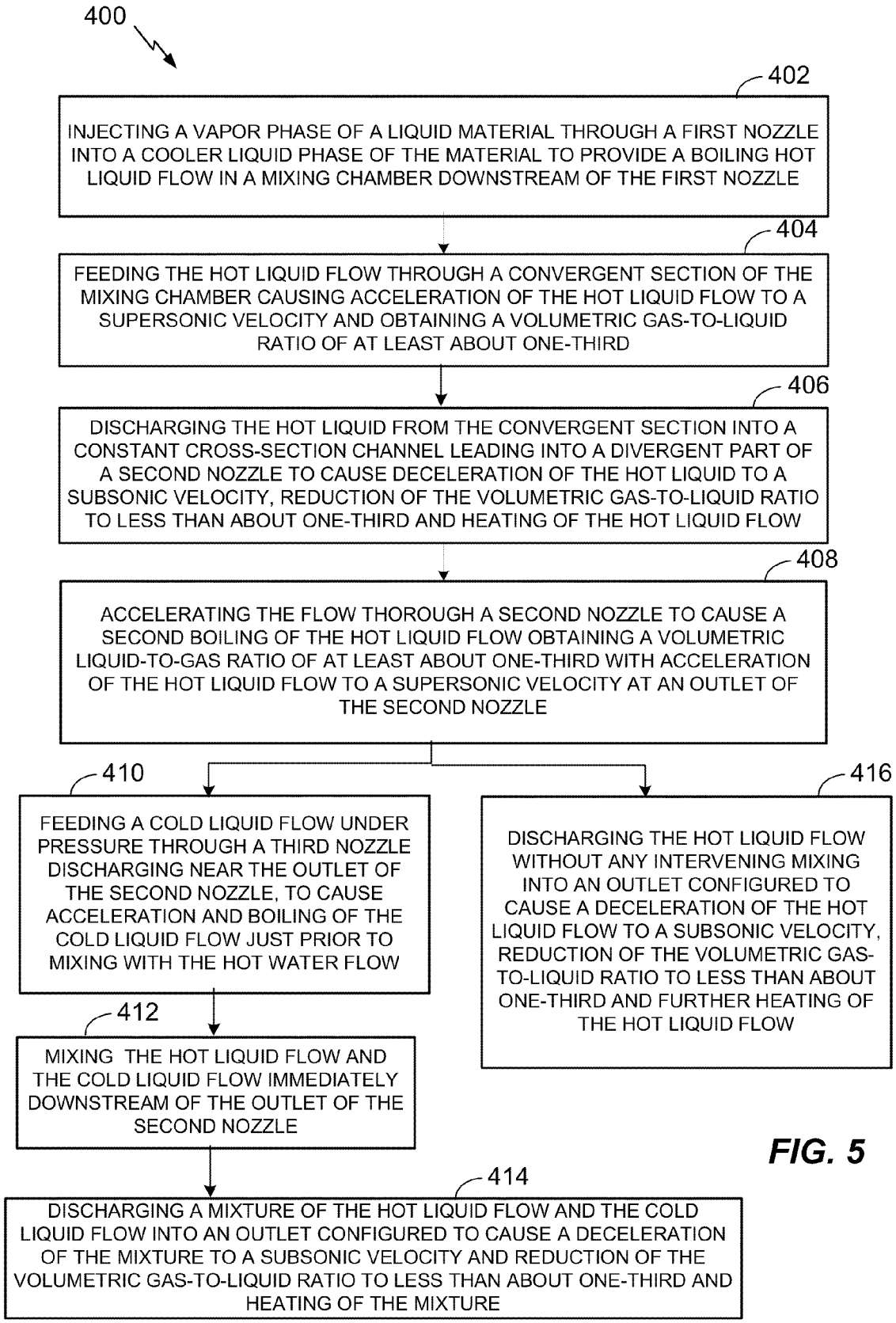
FIG. 5 is a flow diagram showing a method for operating a jet injection apparatus using a hot vapor as a heating medium.

Likewise, a method 400 of operating a jet apparatus for heating a fluid using a hot vapor feed may be performed as follows, as shown in FIG. 5. The method may comprise injecting 402 a vapor phase of a liquid material through a first nozzle into a cooler liquid phase of the material to provide a boiling hot liquid flow in a mixing chamber downstream of the first nozzle. The method may further comprise feeding 404 the hot liquid flow through a convergent section of the mixing chamber causing acceleration of the hot liquid flow to a supersonic velocity and obtaining a volumetric gas-to-liquid ratio of at least about one-third. The method may further comprise discharging 406 the hot liquid from the convergent section into a constant cross-section channel leading into a divergent part of a second nozzle to cause deceleration of the hot liquid to a subsonic velocity, reduction of the volumetric gas-to-liquid ratio to less than about one-third and heating of the hot liquid flow, converting the flow to a homogenous isotropic liquid with entrained microscopic vapor bubbles. The constant cross-section channel may comprise a cylindrical channel having a fluid length in the range of about four to six times its diameter. The method may further comprise accelerating 408 the flow thorough a second nozzle to cause a second boiling of the hot liquid flow obtaining a volumetric gas-to-liquid ratio of at least about one-third with acceleration of the hot liquid flow to a supersonic velocity at an outlet of the second nozzle.

The method 400 may further comprise feeding the cooler liquid phase of the material through a nozzle into the mixing chamber. The method may further comprise feeding 410 a cold liquid flow under pressure through a third nozzle discharging near the outlet of the second nozzle, to cause acceleration and boiling of the cold liquid flow just prior to mixing with the hot water flow. The method may further comprise mixing 412 the hot liquid flow and the cold liquid flow immediately downstream of the outlet of the second nozzle. The method may further comprise discharging 414 a mixture of the hot liquid flow and the cold liquid flow into an outlet configured to cause a deceleration of the mixture to a subsonic velocity and reduction of the volumetric gas-to-liquid ratio to less than about one-third and heating of the mixture. In the alternative, the method may comprise discharging 416 the hot liquid flow without any intervening mixing with a colder fluid into an outlet configured to cause a deceleration of the hot liquid flow to a subsonic velocity, reduction of the volumetric gas-to-liquid ratio to less than about one-third and further heating of the hot liquid flow.

Methods that may be implemented in accordance with the disclosed subject matter have been described with reference to several flow diagrams. While for purposes of simplicity of explanation, the methods are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described herein; and the omission of various different blocks may result in performance by the remaining blocks of one of the alternative embodiments described herein or claimed.

The described methods of operation of heat-generating jet apparatus can be realized at both creation and reconstruction of large-scale sources of heat, and at creation of autonomic heat-generating units, for example, heating systems for different premises with no systems of centralized heating, including those in areas of the Far North, and also for heating and hot water supply of household and office buildings, constructions, cottages and summer residences. These methods can be also realized at creation and reconstruction of industrial waste disposal facilities, radioactive waste disposal plants, water desalination facilities and clean drinking water obtaining plants. The embodiments described herein merely exemplify various apparatus and methods for jet injection. The present technology is not limited by these examples.

What is claimed is:

1. A method, comprising:

feeding a hot liquid flow under pressure into a first nozzle to cause boiling of the hot liquid flow obtaining a volumetric gas-to-liquid ratio of at least about one-third with acceleration of the hot liquid flow to a supersonic velocity in the first nozzle;

discharging the hot liquid from the first nozzle into a divergent section of a second nozzle to cause deceleration of the hot liquid to a subsonic velocity with a sudden change of pressure, reduction of the volumetric gas-to-liquid ratio to less than about one-third and heating of the hot liquid flow, converting the flow to a homogenous isotropic liquid with entrained microscopic vapor bubbles; and accelerating the flow thorough a second section of the second nozzle to cause a second boiling of the hot liquid flow obtaining a volumetric gas-to-liquid ratio of at least about one-third with acceleration of the hot liquid flow to a supersonic velocity at an outlet of the second nozzle.

2. The method of claim 1, further comprising feeding a cold liquid flow under pressure through a third nozzle discharging near the outlet of the second nozzle, to cause acceleration and boiling of the cold liquid flow just prior to mixing with the hot water flow.

3. The method of claim 2, further comprising mixing the hot liquid flow and the cold liquid flow immediately downstream of the outlet of the second nozzle.

4. The method of claim 3, further comprising discharging a mixture of the hot liquid flow and the cold liquid flow into an outlet configured to cause a deceleration of the mixture to a subsonic velocity with a sudden change of pressure and reduction of the volumetric gas-to-liquid ratio to less than about one-third and heating of the mixture.

5. The method of claim 1, further comprising discharging the hot liquid flow into an outlet configured to cause a deceleration of the hot liquid flow to a subsonic velocity, reduction of the volumetric gas-to-liquid ratio to less than about one-third and further heating of the hot liquid flow.

6. The method of claim 1, further comprising feeding the hot liquid flow into the first nozzle through a sharp-edged mouth.

* * * * *